US007073828B2

(12) United States Patent
Foigel et al.

(10) Patent No.: US 7,073,828 B2
(45) Date of Patent: Jul. 11, 2006

(54) CABLE LOCK AND METHOD

(75) Inventors: Veniamin A. Foigel, Vinnitsa (UA); Igor B. Matviev, Vinnitsa (UA); Sergei F. Shapovalov, Vinnitsa (UA); Uriy A. Vvedenskiy, Vinnitsa (UA); Sergei A. Rogkov, Vinnitsa (UA); Anatoliy A. Romov, Gnivan (UA); Gregory Kleynerman, Milwaukee, WI (US)

(73) Assignee: Alpha Cargo Technology, LLC, Bayside, WI (US)

( * ) Notice: Subject to any disclaimer, the term of this patent is extended or adjusted under 35 U.S.C. 154(b) by 0 days.

(21) Appl. No.: 10/614,457

(22) Filed: Jul. 9, 2003

(65) Prior Publication Data

US 2005/0006910 A1 Jan. 13, 2005

(51) Int. Cl.
*B65D 55/06* (2006.01)

(52) U.S. Cl. ..... 292/315; 292/307 R; 292/323; 292/327; 24/136 A; 24/115 N; 24/115 L; 24/122.6

(58) Field of Classification Search ..... 292/315, 292/307 R, 252, 320, 327; 24/136 A, 115 N, 24/115 L, 122.6, 703.1–703.6
See application file for complete search history.

(56) References Cited

U.S. PATENT DOCUMENTS

| | | | | | |
|---|---|---|---|---|---|
| 1,030,457 | A * | 6/1912 | Brooks | 292/317 |
| 1,577,678 | A * | 3/1926 | Behrman | 292/325 |
| 3,994,521 | A * | 11/1976 | Van Gompel | 292/319 |
| 4,681,356 | A * | 7/1987 | Brammall | 292/327 |
| 4,747,631 | A * | 5/1988 | Loynes et al. | 292/307 R |
| 5,170,537 | A * | 12/1992 | Sperling | 24/136 A |
| 5,222,776 | A * | 6/1993 | Georgopoulos et al. | 292/323 |
| 5,352,003 | A * | 10/1994 | Bystry | 292/323 |
| 5,359,870 | A * | 11/1994 | Reutlinger | 70/456 R |
| 5,382,061 | A * | 1/1995 | Swift et al. | 292/311 |
| 5,820,176 | A * | 10/1998 | Leon et al. | 292/323 |
| 6,155,617 | A * | 12/2000 | Kuenzel | 292/318 |
| 6,293,599 | B1 * | 9/2001 | Garcia | 292/317 |
| 6,345,847 | B1 * | 2/2002 | Dreisbach et al. | 292/323 |
| 6,371,539 | B1 * | 4/2002 | Olshausen | 292/307 R |
| 6,406,074 | B1 * | 6/2002 | Mahaney | 292/327 |
| 6,540,273 | B1 * | 4/2003 | Brammall et al. | 292/315 |
| 6,550,830 | B1 * | 4/2003 | Kueznel | 292/327 |

FOREIGN PATENT DOCUMENTS

UA 292 2/1999

OTHER PUBLICATIONS

Drawing of a cable lock. The cable lock appears to include a housing 1, a cable 2 and an aperture 10 defined in the housing 1 for receiving the cable 2 to lock the cable lock. Publicly available prior to Jul. 9, 2003.

* cited by examiner

*Primary Examiner*—Brian E. Glessner
*Assistant Examiner*—Carlos Lugo
(74) *Attorney, Agent, or Firm*—Michael Best & Friedrich

(57) ABSTRACT

Some embodiments of the cable lock provide a body defining a housing in which a cable can be received to lock the cable lock. In some embodiments, the cable is rotatable with respect to the housing when the cable lock is in a locked state, thereby increasing the difficulty of circumventing the lock. The cable lock can have a wall with an aperture shaped to compliment the cross-sectional shape of the cable passed therethrough, an end wall that can be attached to the housing by rolling or crimping an edge of the housing over the end wall, and/or one or more visual indicators providing a manner by which tampering of the cable lock can be detected.

15 Claims, 7 Drawing Sheets

CABLE LOCK AND METHOD

FIELD OF THE INVENTION

The present invention relates generally to locking apparatuses and methods, and more particularly, to cable locks and locking methods.

BACKGROUND OF THE INVENTION

Many varieties of locking devices exist in today's marketplace and are used to lock a variety of different devices or items. Some of these conventional locking devices are cable locks. Such conventional cable locks typically include a housing and a cable having one end connected to the housing and a second end insertable into and locked to the housing. These conventional cable locks typically use a wire cable having a plurality of metal wires twisted around each other to form a single cable. Wire cables typically have a spiraled exterior surface created by the twisting of the wires. Conventional cable locks typically have an unlocked state in which a free end of the cable is not inserted into the housing, and a locked state in which the free end of the cable is inserted into the housing and is locked thereto by an engaging member or locking member positioned within the housing.

Through patience, skill, and (at times) significant resources and ingenuity, thieves have found one or more manners to defeat virtually every cable lock in the marketplace. In many applications suitable for cable locks, success for a thief lies not in the ability to circumvent a cable lock (which can readily be done simply with cable cutters, liquid nitrogen and a hammer, or in other manners employing brute force), but to do so in an undetected manner. By circumventing a cable lock without being detected, efforts of security personnel to detect the theft in a timely manner and to determine when and/or where the theft occurred is compromised. Many different manners of circumventing conventional cable locks have been employed throughout the years, some of which will now be described for purposes of illustration and example.

Some conventional cable locks define an inlet aperture in a wall of the housing to allow insertion of the cable into the housing. Such inlet apertures are typically round. When a cable (such as a wire cable) is inserted into the inlet apertures, gaps are present between the cable and the edge of the inlet aperture due to the gaps created between the spirals of the cable. Such gaps provide a place through which thieves can gain entry into the internal elements of the cable lock (e.g., with picks and other tools) to potentially unlock the cable lock. By unlocking the cable lock in this manner, the thieves can re-lock the cable lock after a theft to reduce the chances that the theft will be quickly detected.

Some conventional cable locks include engaging members or locking members (e.g., balls, pins, discs, tabs, and the like) that are retained within the housing of the cable locks and grip the cable received therein. Such locking members grip the cable and provide resistance to cable withdrawal out of the housing in a direction opposite that of cable insertion. Thieves have bypassed these types of conventional cable locks by repeatedly twisting the cable with force in clockwise and counter-clockwise directions in order to create slippage between the cable and the engaging or locking members until the cable is completely removed from the housing in the insertion direction. In this manner, the cable lock can be re-locked after a theft to delay detection of the theft.

Many conventional cable locks include housings defining an internal cavity having an enclosed end and an open end through which the internal components of the cable lock are inserted into the cavity during manufacturing of the cable lock. The open end is sealed off by positioning an end cap in the open end of the housing and by crimping the housing around the end cap. Such crimping of the housing secures the end cap in place in the open end of the housing. However, crimping the housing to around the end cap can create gaps between the edge of the end cap and the housing through which picks and other tools can be inserted to unlock the lock. In some cases, thieves position a tool or machine within the gap and pry the end cap out from the open end of the housing or uncrimp the open end of the housing in order to remove the end cap from the open end of the housing. In either case, access is thereby provided to the internal components of the cable lock. To delay detection of a theft, the thieves can replace the end cap in the open end of the housing and can re-crimp the housing using a tool or machine to once again secure the end cap in place.

Conventional cable locks typically employ a cable permanently secured with respect to the housing and having a free end for insertion into the housing as described above. In order for the first end of the cable to be permanently secured with respect to the housing, some conventional cable locks have a projection or other body portion connected or integral with the housing. This projection or other body portion has an aperture through which the cable is passed, after which time the projection or other body portion is crimped to secure the cable with respect to the housing. However, thieves have bypassed such cable locks by cutting the cable, using a machine or tool (e.g., a drill) to remove the cut cable from the aperture, inserting a new cable, and re-crimping the new cable in the aperture.

By using the methods discussed above and others on conventional cable locks, it is often difficult to identify that the locks have been bypassed. In some applications (such as for trailers, cargo containers, and other mobile cargo storage units used to move cargo), the popular use of conventional cable locks is exacerbated due to the added difficulty in identifying where the theft took place during transit. Having more prompt information indicating that a theft has occurred could more easily lead law enforcement agencies to the thieves and the stolen goods.

In light of the above problems and issues (as well as others known to those in the art but not discussed herein), an improved cable lock and locking method would be welcome in the art.

SUMMARY OF THE INVENTION

Some embodiments of the present invention provide a cable lock having a cable with a cross-sectional shape and a radius varying at different circumferential positions of the cross-sectional shape, a housing defining an internal cavity therein, and a wall positioned to block access into the cavity of the housing, wherein the wall has an aperture defined therethrough with a radius varying at different circumferential positions of the aperture, and at least a portion of the cross-sectional shape of the cable has a shape complementary to the shape of the aperture to inhibit ingress of an object into the internal cavity of the housing between the cable and the wall.

In some embodiments, a method of locking a cable lock is provided in which an end of a cable is inserted into and through an aperture of a wall, wherein the cable has a cross-sectional shape with a radius varying at different circumferential positions of the cable, wherein the aperture has a cross-sectional shape with a radius varying at different circumferential positions of the aperture, and wherein the cable and aperture have complementary shapes. The method also includes inserting an end of the cable into and through a housing in a first direction, preventing movement of the cable through the housing in a second direction substantially opposite the first direction, and blocking ingress of objects into the housing along a surface of the cable through the aperture by the complementary shapes of the cable and aperture.

In another aspect of the present invention, a cable lock is provided, and has a body with a first portion defining a housing having an internal cavity and a second portion having an aperture therethrough and a visible indicator thereon, wherein the visible indicator is deformable under force applied to the second portion. The cable lock also has a cable retained within the aperture in the second portion of the body, wherein the cable has an end insertable into the internal cavity of the housing to lock the cable lock.

Some embodiments of the present invention also provide a method of assembling a cable lock, including providing a body having a first portion defining a housing and a second portion, forming visible indicia upon the second portion of a body, wherein the visible indicia is deformable under force applied to the second portion of the body, inserting a cable into an aperture in the second portion of the body, and securing the cable within the aperture in the second portion of the body.

The present invention according to some embodiments also provides a cable lock having a housing and a cable insertable into the housing in a first direction, wherein the cable has a locked state within the housing in which the cable is movable with respect to the housing in the first direction but is restrained against movement with respect to the housing in a second direction substantially opposite the first direction, and wherein the cable is rotatable relative to the housing when in the locked state.

Also, the present invention according to some embodiments further includes a method of locking a cable lock, including inserting a cable into a housing in a first direction, feeding the cable into the housing to a locked position in which the cable is restrained from motion in a second direction substantially opposite the first direction, and rotating the cable with respect to the housing in the locked position of the cable.

Other features and advantages of the present invention will become apparent to those skilled in the art upon review of the following detailed description, claims, and drawings.

BRIEF DESCRIPTION OF THE DRAWINGS

The present invention is further described with reference to the accompanying drawings, which show exemplary embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

DETAILED DESCRIPTION

Figure 1:
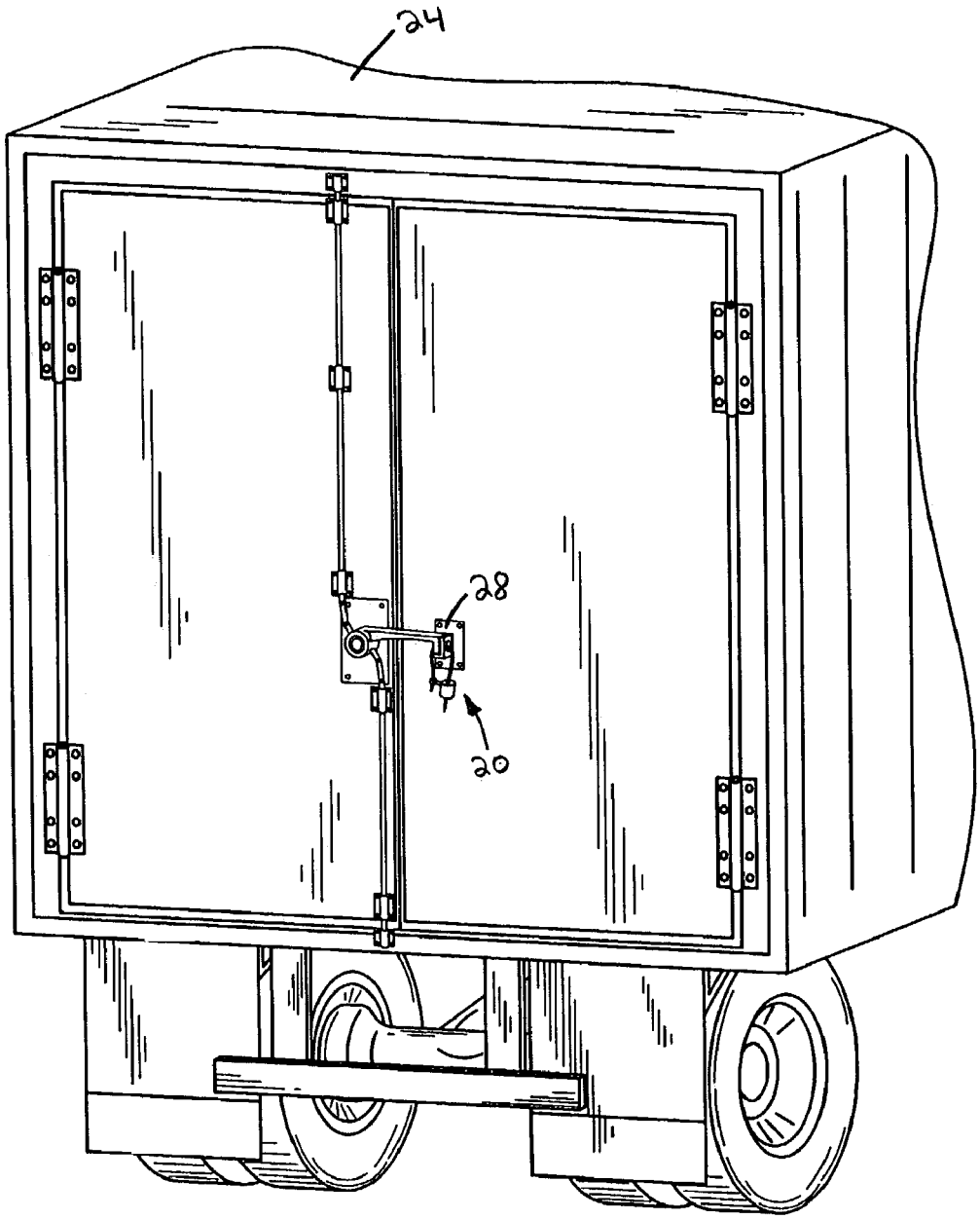
FIG. 1 is a perspective view of a trailer utilizing a cable lock according to an exemplary embodiment of the present invention.
Figure 3:
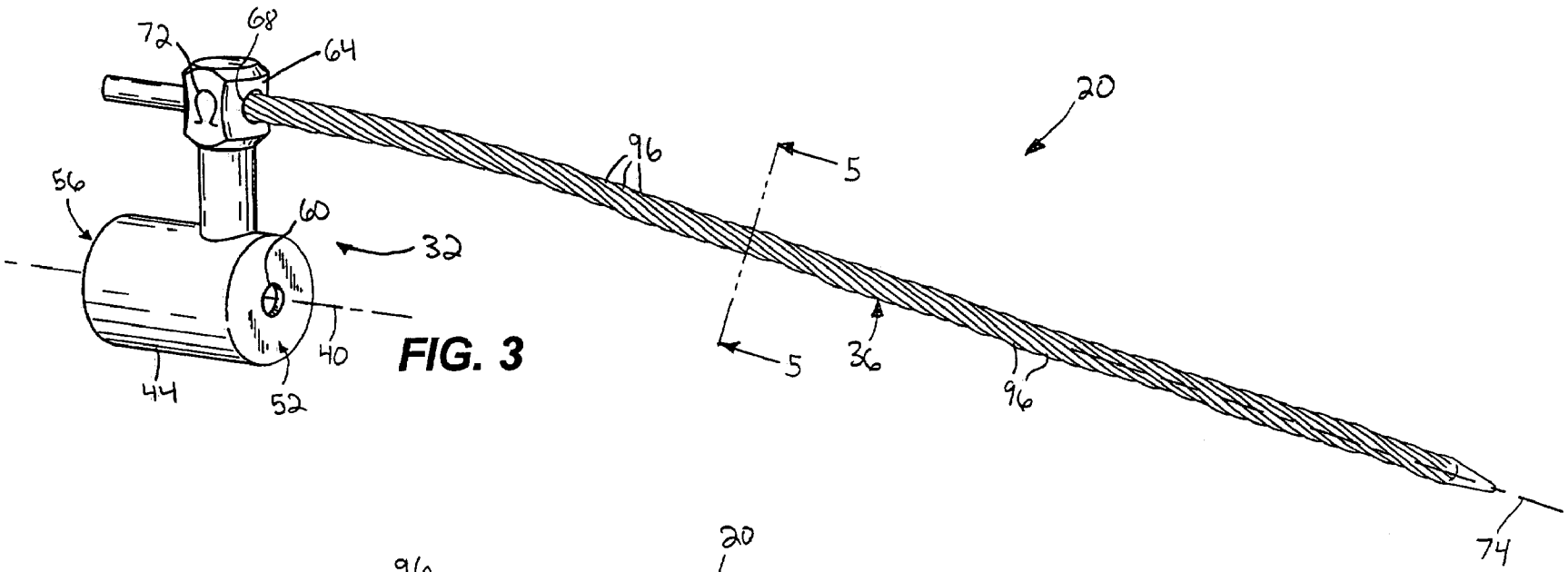
FIG. 3 is a perspective view of the cable lock shown in FIG. 1, shown in an unlocked state.
Figure 2:
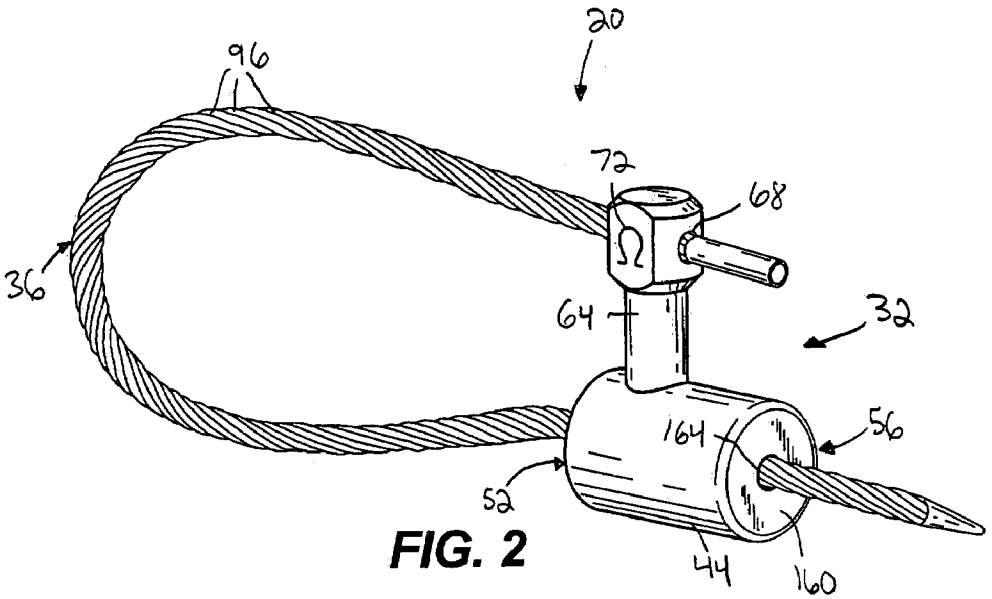
FIG. 2 is a perspective view of the cable lock shown in FIG. 1, shown in a locked state.

Referring to FIG. 1, a cable lock 20 according to an exemplary embodiment of the present invention is illustrated in combination with a vehicle trailer 24. Like other cable locks, the cable lock 20 can be employed to secure a wide variety of items and areas, such as, for example, trailers and cargo containers transportable by a truck, boat, train, etc., other types of containers, doors, gates, machinery, equipment, or any other item or device that can be locked or otherwise secured with a cable lock. The cable lock 20 can be employed in conjunction with any type of latch to secure the latch from release. By way of example only, and as illustrated in FIG. 1, a cable lock 20 can be used in combination with a latching device 28 mounted on a vehicle trailer 24 to lock one or more doors of the trailer 24. Alternatively, the cable lock 20 can be used to secure items and areas in other manners, such as by wrapping around handles of doors, passing a cable of the cable lock through apertures or other features of the items to be secured, and the like.

With reference to FIGS. 2–5, some embodiments of the cable lock 20 according to the present invention include a body 32 and a cable 36 connected to the body 32. The cable lock 20 has a locked state or locked condition (see FIG. 2) in which the cable 36 is inserted into the body 32, and an unlocked state or unlocked condition (see FIG. 3) in which the cable 36 is not inserted into the body 32. In some embodiments, the cable 36 is inserted substantially along an insertion axis 40 passing into and/or through the body 32 (e.g., see FIGS. 3–4).

The body 32 includes a housing 44 defining a cavity 48 therein within which internal components of the cable lock 20 are housed. The housing 44 can have any shape desired, including without limitation cubical, cubeoidal, polyhedral, prismatic, spherical, elliptical, frusto-conical, and frusto-pyramidal. In the illustrated exemplary embodiment, the housing 44 is substantially cylindrical in shape.

The housing 44 can have at least one open end into which internal components of the cable lock 20 can be received during assembly. In some embodiments, only one end of the housing 44 is open, while an opposite end is substantially closed by an end wall of the housing 44. In other embodiments, both ends of the housing 44 are open, and can be substantially closed by separate elements of the cable lock 20 (such as by two walls each similar to the end cap 160 in the illustrated exemplary embodiment). In the illustrated embodiment, the housing 44 is substantially cylindrical and has an open end 56 and a closed end 52 defined by a wall of the housing 44.

An inlet 60 can be defined in an enclosed end 52 of the housing 44 for passage of a cable 36 into and/or through the housing 44. Alternatively, the inlet 60 can be defined in a separate element of the cable lock 20 for this same purpose. In either case, the inlet 60 can be substantially aligned with an insertion axis 40 of the housing 44 (described above). In the illustrated embodiment, the inlet 60 is substantially circular in shape. However, the inlet 60 can have any other shape desired, such as, for example, triangular, rectangular, trapezoidal, or any other polygonal shape, oval, irregular, and the like.

In some embodiments of the present invention, the body 32 also has another portion to which the cable 36 is permanently attached. In this regard, the body 32 can have any shape capable of providing such an attachment location. For example, the housing 44 can have a portion 64 thereon or extending therefrom defined by a lug, boss, post, block, or other element to which the cable 36 is permanently attached. In some embodiments, the housing 44 itself can be shaped to provide a permanent connection point of the cable 36. One body shape is illustrated in the figures by way of example only. Specifically, the illustrated body 32 has a housing 44 and a portion 64 extending from the housing 44 and defining an aperture 68 therein in which the cable 36 is received. The cable 36 can be permanently secured to this portion 64 of the body 32 in a number of manners, including without limitation by welding, brazing, soldering, and the like (some connection manners suitable with or without the use of an aperture 68 through which the cable 36 passes as will be appreciated by one having ordinary skill in the art). In the illustrated exemplary embodiment, the cable 36 is permanently secured within the aperture 68 of the body 32 by crimping the portion 64 of the body 32 defining the aperture 68, thereby compressing and securing the cable 36 within the cable aperture 68. Accordingly, this portion 64 of the body 32 in some embodiments can be referred to as a crimp portion 64 of the body 32. In some embodiments, one or more visual indicators 72 can be located on each side of the crimp 64 for indicating whether the portion 64 of the body to which the cable 36 is permanently secured has been tampered with (discussed in greater detail below).

In those embodiments in which the cable 36 is permanently secured to a separate portion 64 of the body 32 (apart from the housing 44) this portion can be connected to the housing 44 in a variety of different manners, such as, for example by welding, brazing, crimping, or soldering, by one or more conventional fasteners, by inter-engaging elements on the portion 64 and the housing 44, by a snap-fit, press-fit, or threaded connection between the portion 64 and the housing 44, and the like. The housing 44 and the body portion 64 to which the cable 36 is permanently secured can also be integrally formed, thereby making the body 32 a single integral piece.

As used herein and in the appended claims, the term "cable" means any elongated item that can be permanently connected at a point along its length (e.g., a first end as shown in the exemplary illustrated embodiment) to the body 32 as discussed above and a second end insertable into and through the housing 44 to place the cable lock in the locked state. In this regard, the cable is permanently connected at least to the extent that the cable is secured to the body 32 and cannot be removed without the use of tools or machinery or without damage or destruction of the cable 36, body 32, or other lock component(s). In the illustrated embodiment, the cable 36 is a metallic bendable wire cable and consists of a plurality of metallic wires wound or twisted about a longitudinal cable axis 74 (when the cable is in an unbent state) to give the cable 36 a spiral shape. Alternatively, the cable 36 can be other type of elongated item capable of performing the same functions described herein, such as, for example a rope, a chain, a rod, bar, or strip bent in a shape permitting rod connection to the body 32 and rod insertion within the housing 44, a flexible tape, wire, rod, bar, strip, or other flexible elongated element permitting the same connections, and the like. The cable 36 can be made of any material desired, including without limitation any suitable type of metal, plastic or composite material, fabric, and the like (keeping in mind that an important function of the lock 20 in some applications is not necessarily to prevent circumvention of the lock 20, but to indicate when the lock 20 has been tampered with).

Figure 5:
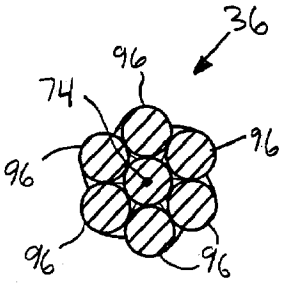
FIG. 5 is a cross-sectional view of the cable employed in the cable lock shown in FIG. 1, taken along line 5—5 of FIG. 3.

In some embodiments of the present invention, the cable 36 has a cross-sectional shape having a radius that varies at different circumferential positions of the cross-sectional shape (see FIG. 5). In other words, the cross-sectional shape of the cable 36 is not round in such embodiments. In some embodiments, this varying radius is a product of the type of cable employed. For example, the multi-strand wound metal cable utilized in the illustrated embodiment defines a non-constant radius. Alternatively, the cable 36 can have a cross-section of other shapes, such as, for example substantially round, oval, or elliptical, substantially triangular, rectangular, trapezoidal, or having any other polygonal shape (with or without curved sides and/or corners), irregular, and the like. In this regard, the term "radius" and variations thereof herein and in the appended claims is used broadly and refers to the distance between a center of any shape and the edge of that shape at any given circumferential location of the shape, and does not indicate or imply the shape of the cross-section. In other words, as used herein and in the appended claims, a square (for example) can have a "radius" at any given location on the edge of the square defined by the distance between the center of the square and that location. Also, the term "circumference" and variations thereof used herein and in the appended claims is used broadly and refers to the external boundary or surface of any figure, object, or shape, and does not indicate or imply any particular shape. Accordingly as used herein and in the appended claims, a square (for example) has a "circumference" defined by the periphery of the square.

In some embodiments, the cable 36 an end of the cable 36 is tapered or is otherwise reduced in size to ease insertion of the cable 36 into the housing 44. For example, the cable 36 in the illustrated exemplary embodiment has an end that is frusto-conically shaped. This end of the cable 36 can be frusto-conically shaped in a variety of manners, such as, for example, by grinding the end of the cable to generate heat sufficient to melt the cable into the desired shape (e.g., melting the ends of the strands in a multi-strand wound metal cable), by melting or fusing the end of the cable 36 in any other manner, by connecting a separate frusto-conical shaped component to the second end (such as by welding, brazing, soldering, crimping, gluing, and the like), etc. Insertion of the cable 36 into the housing 44 will be discussed in greater detail below.

With continued reference to FIGS. 2–5, some embodiments of the lock 20 also include a spacer 76 positioned within the cavity 48 at an end of the housing 44 into which the cable 44 is inserted as will be described in greater detail below. In the illustrated embodiment, the spacer 76 is made of a low friction material and/or has polished, waxed or otherwise smooth surfaces for reasons that will become apparent herein. The spacer 76 has an aperture 80 therethrough and in the illustrated embodiment is positioned adjacent the closed end 52 of the housing 44 (although the spacer 76 could instead be located at either end of the housing 44 depending upon the arrangement of internal components as described in greater detail below). The aperture 80 of the spacer 76 can be substantially aligned with the insertion axis 40 of the housing 44. In the illustrated embodiment, the spacer 76 is substantially round and matches the internal cross-sectional shape of the housing 44. However, the spacer 76 can have a variety of other cross-sectional shapes that can (but do not necessarily) match the shape of the cavity 48. By way of example only, the spacer 76 can be triangular, oval, rectangular, can have an irregular shape, or can have any other polygonal or non-polygonal shape desired. Also in the illustrated embodiment, the inlet 60 and the spacer aperture 80 are substantially the same size and are substantially the same shape. However, the inlet 60 and the spacer aperture 80 can be sized differently (i.e., the inlet 60 being larger than the spacer aperture 80 or vice versa), and can have different shapes while still falling within the spirit and scope of the present invention.

Figure 4:
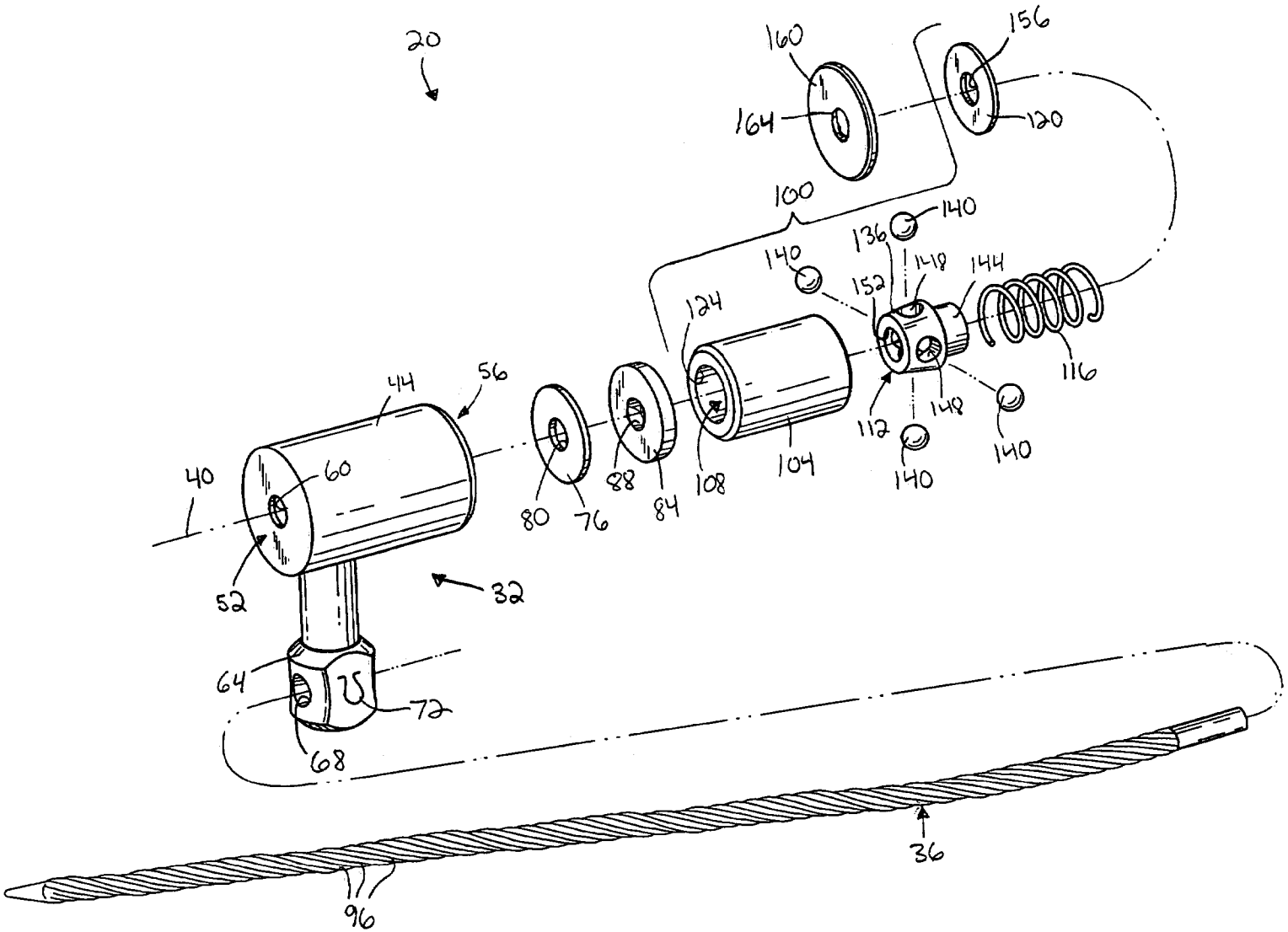
FIG. 4 is an exploded perspective view of the cable lock shown in FIG. 1.
Figure 7:
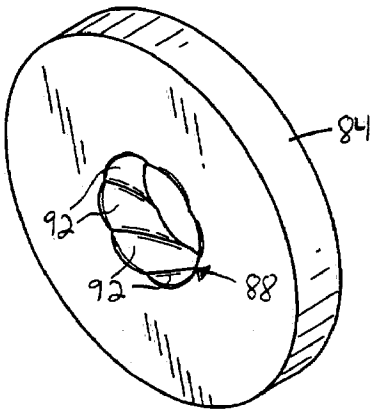
FIG. 7 is a perspective view of the wall shown in FIG. 6.
Figure 6:
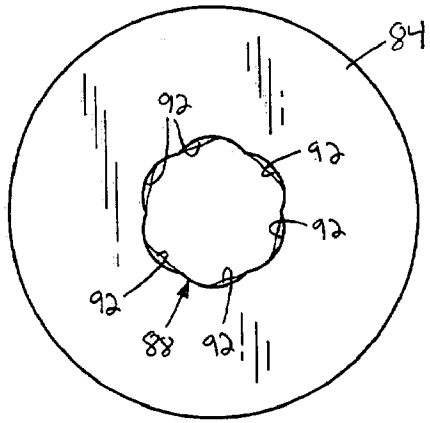
FIG. 6 is a front view of a wall of the cable lock shown in FIG. 1.

Referring now to FIGS. 4, 6, and 7, the body 32 also includes a wall 84 positioned within the cavity 48. In those embodiments employing a spacer 76 as described above, the wall 84 can be located adjacent the spacer 76 (which can be positioned between the wall 84 and the end 52 of the housing 44). An aperture 88 is defined through the wall 84, and in some embodiments is substantially aligned with the insertion axis 40 of the housing 44. In the illustrated exemplary embodiment, the wall aperture 88 has a plurality of grooves 92 (see FIG. 7) defined in the periphery of the aperture 88. These grooves 92 can be dimensioned and shaped to complement the cross-sectional shape of the cable 36. In other embodiments, the aperture 88 has any other edge shape desired, including without limitation round, oval, triangular, rectangular, trapezoidal (or any other polygonal shape), irregular, and other shapes, and can also be shaped to complement any cross-sectional shape of any cable 36.

Because many multi-strand wound metal cables have wires that are twisted about an axis of the cable 36 (in a helical fashion), the grooves 92 in the wall aperture 88 can be helically shaped to match such cables 36, as best shown in FIGS. 6 and 7. Spiraled grooves 92 therefore complement spirals 96 of the cable 36 when the cable 36 is inserted through the wall aperture 88 (discussed in greater detail below). The spiraled strands 96 of the cable 36 can therefore be received within the spiral grooves 92 defined in the edge of the wall aperture 88 to form a tight engagement between the spiraled strands 96 of the cable 36 and the wall 84. Such a spiraled shape can also be employed for any other aperture shape desired in order to compliment the shape of any cable.

Viewed from a front or rear of the wall 84, the spiral grooves 92 of the wall aperture 88 provide the wall aperture 88 with a radius varying at different circumferential locations of the wall aperture 88 to complement a similar cross-sectional shape of the cable 36. In other words, the wall aperture 88 in the illustrated exemplary embodiment appears to have a scalloped edge as viewed from a front or rear of the wall 84. Alternatively, and as mentioned above, the wall aperture 88 can have any other shape desired to (in some embodiments) compliment or match the cross-sectional shape of the cable 36 passed therethrough, thereby forming form a closer engagement between the cable 36 and the wall 84 when the cable 36 is inserted through the wall aperture 88.

With particular reference to FIG. 4, the body 32 further includes a locking assembly 100 operable to engage the cable 36 and to place the cable lock 20 in a locked state. The locking assembly 100 allows the cable 36 to be inserted therethrough in a first direction, (from the inlet 60 to the open end 56 of the housing 44 in the illustrated exemplary embodiment), and prevents the cable 36 from being pulled out of the housing 44 in a second direction opposite the first direction. In some embodiments, the locking assembly 100 is separate from the housing 44 and has parts operable to move relative to the housing 44 in a rotational and/or axial manner (discussed in greater detail below).

The exemplary locking assembly 100 illustrated in the figures includes a locking assembly housing 104 defining a cavity 108 therein, a carriage 112 positioned within the housing 104, a spring 116, and a locking assembly end cap 120. The locking assembly housing 104 defines an inlet 124 in one end thereof. The inlet 124 of the locking assembly housing 104 can be substantially aligned with the insertion axis 40. The cavity 108 of the illustrated locking assembly housing 104 has a diameter that increases away from the inlet 124 of the locking assembly housing 104. Although a number of different internal shapes of the locking assembly housing 104 having such an increasing diameter can be employed in the present invention, in some embodiments the cavity 108 of the locking assembly housing 104 has a portion 128 with a substantially constant diameter and another portion 132 with a gradually narrowing diameter (see FIGS. 10 and 11) as just described. In other embodiments, the locking assembly housing 104 has no portion with a substantially constant internal diameter.

A carriage aperture 152 is defined through the carriage 112, can be aligned with the insertion axis 40 of the housing 44, and is shaped and dimensioned to permit the cable 36 to be passed therethrough. The carriage 112 of the locking assembly 100 functions to hold one or more cable grips or gripping elements, such as balls, plates, pins, tabs, discs, within the locking assembly 100. Such support for gripping elements can be provided in a number of different manners, each of which falls within the spirit and scope of the present invention. By way of example only, the carriage 112 in the illustrated embodiment has includes a grip support 136 shaped to support one or more grips 140 (in the form of balls 140) therein. This exemplary carriage 112 also has a spring retainer 144 shaped to retain an end of the spring 116. Although the locking assembly 100 can have any number of gripping elements (e.g., balls 140), the illustrated locking assembly 100 has four balls 140 retained within the carriage 112. The balls 140 are supported within receptacles 148 defined in the carriage 112 and in some embodiments are freely moveable therein. The balls 140 can be retained in place with respect to the carriage in any other manner, such as by being received within a circumferential groove of the carriage 112, by being received within one or more slots or other apertures in the carriage 112, and the like.

If employed, the spring retainer 144 of the carriage 112 can be smaller in diameter than the grip support 136 and can be shaped and sized to receive an end of the spring 116 therearound. Alternatively, the spring 116 can be received within a groove, wall, or other feature of the carriage 112, or can be positioned with respect to the carriage 112 in any other manner permitting the spring 116 to bias the carriage 112 toward the inlet 60 while permitting passage of the cable 60 into and through the housing 44. The spring 116 engages the carriage 112 and biases the carriage 112 in a direction toward the inlet 60 of the housing 44.

In the illustrated embodiment, the spring 116 is a coil spring. Alternatively, the spring 116 can be other types of springs, such as, for example a leaf spring, a Belville washer, a resilient bushing, any other type of biasing member that can bias the carriage 112 toward the inlet 60 of the housing 44. Any number of springs can be employed to bias the carriage 112 as described above.

The locking assembly end cap 120 is positioned at the opposite end of the carriage 112 from the inlet 124, and can be attached to the carriage 112 in any manner, such as by one or more fasteners, by crimping the end cap 120 as shown in the illustrated embodiment, by welding, brazing, soldering, crimping, or gluing, by a snap-fit or interference fit with the end of the carriage 112, or in any other manner. The end cap 120 can close off the cavity 108 with the exception of an end cap aperture 156 therethrough for passage of the cable 36, and can be aligned with the insertion axis 40 of the housing 44. The end cap 120 can also provide a surface against which the spring 116 can press. However, it should be noted that in alternative embodiments, the end cap 120 is not employed, and the spring 116 instead engages the end wall 60 of the housing 44.

Figure 9:
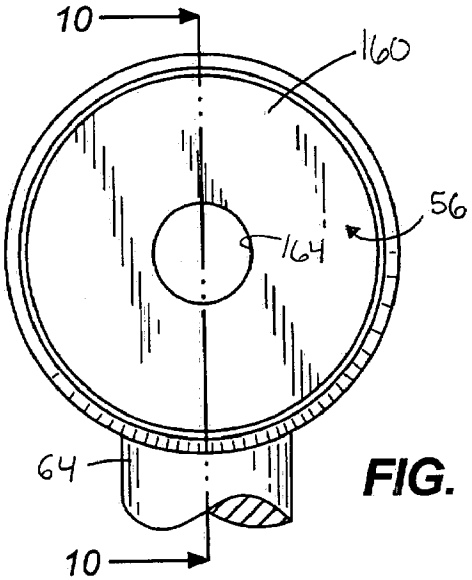
FIG. 9 is a partial end view of the cable lock shown in FIG. 1.
Figure 8:
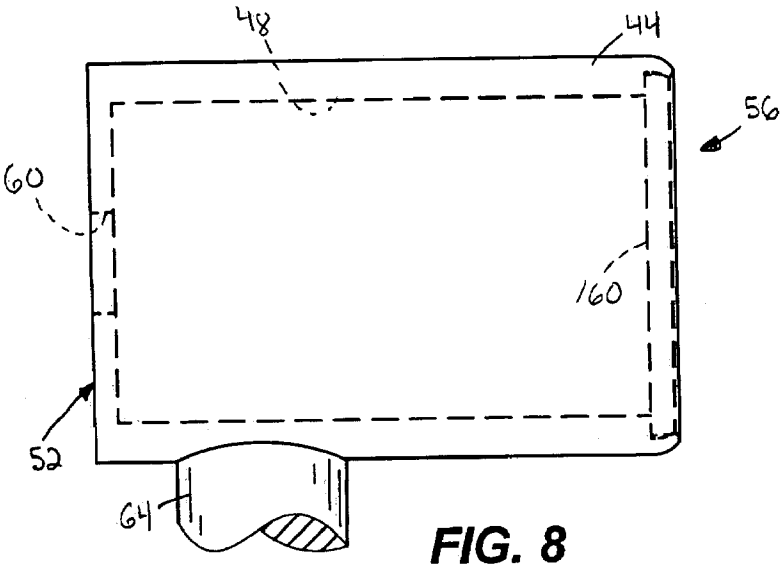
FIG. 8 is a partial side view of the cable lock shown in FIG. 1.

Referring now to FIGS. 4 and 8–9, the housing 44 of the illustrated exemplary embodiment further includes an end cap 160 secured at the open end 56 of the housing 44 to close off the cavity 48 (with the exception of an aperture 164 therethrough). The end cap 160 can be secured to the housing 44 in any manner, including those described above with reference to the connection between the end cap 120 and the carriage 112. In the illustrated embodiment, the housing 44 is crimped or rolled over and around the edges of the end cap 120 to eliminate gaps between the housing 44 and the end cap 160. In some embodiments, the housing 44 extends over and slightly past the end cap 160, and is crimped or rolled over the periphery of the end cap 160 such that an annular portion of the external face of the end cap 160 is covered by the edge of the housing 44. An end cap aperture 164 is defined through the end cap 160, and can be substantially aligned with the insertion axis 40 of the housing 44.

Figure 10:
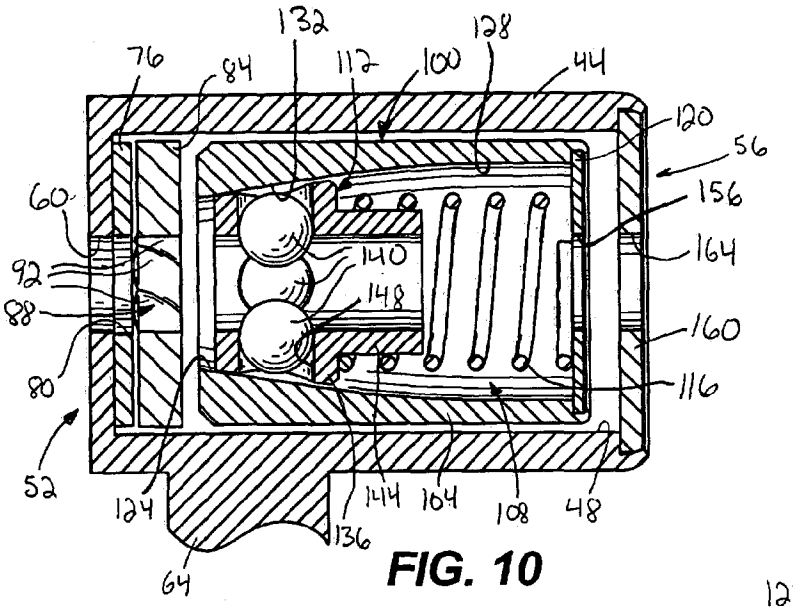
FIG. 10 is a cross-sectional view taken along line 10—10 in FIG. 9, with the cable lock shown in an unlocked state.

With particular reference to FIG. 10, the unlocked state of the exemplary cable lock 20 illustrated in the figures will now be described. In the unlocked state, the cable 36 is not inserted into and through the body 32. The carriage 112 is biased forward (toward the inlet 60 of the housing 44) by the spring 116, and the balls 140 engage the narrowing diameter portion 132 of the cavity 108 toward the locking assembly inlet 124. In this forward condition, the balls 140 are biased inward toward each other by the narrowing diameter portion 132, and are closely spaced together.

Figure 11:
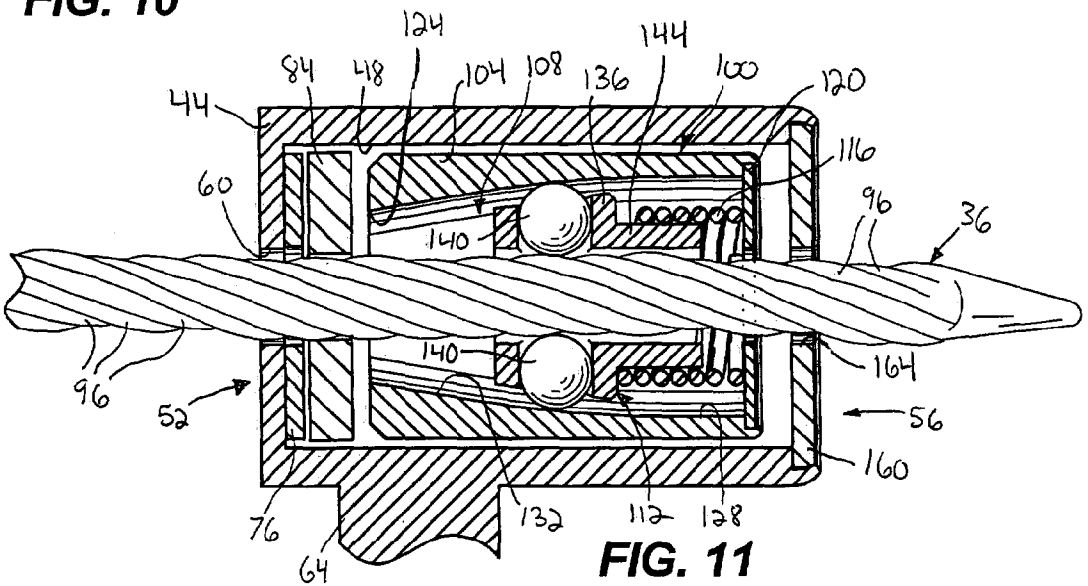
FIG. 11 is a cross-sectional view similar to the cross-sectional view shown in FIG. 10, shown with the cable lock in a locked state.
Figure 11A:
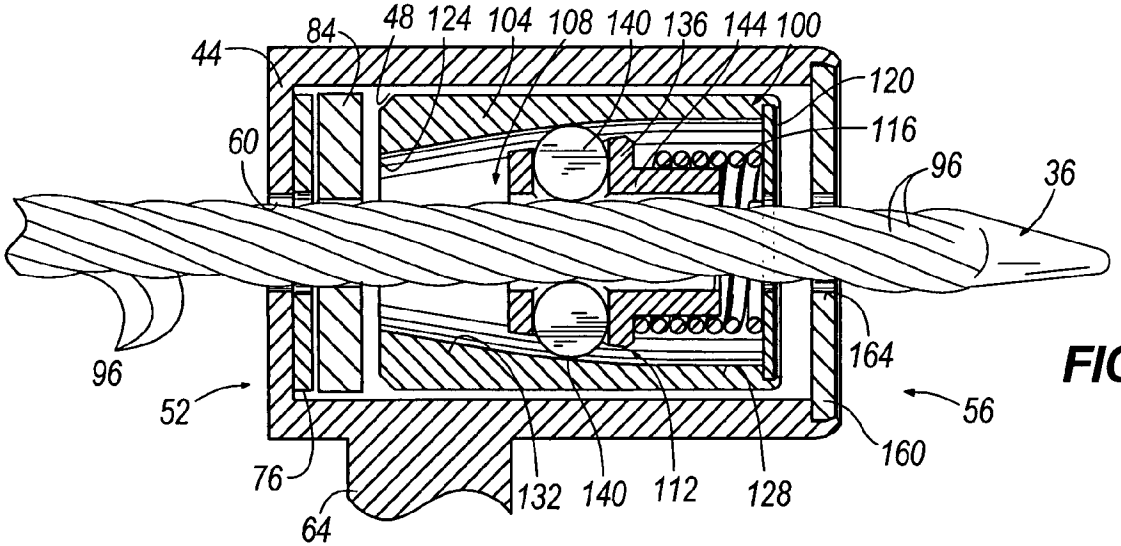
Figure 11B:
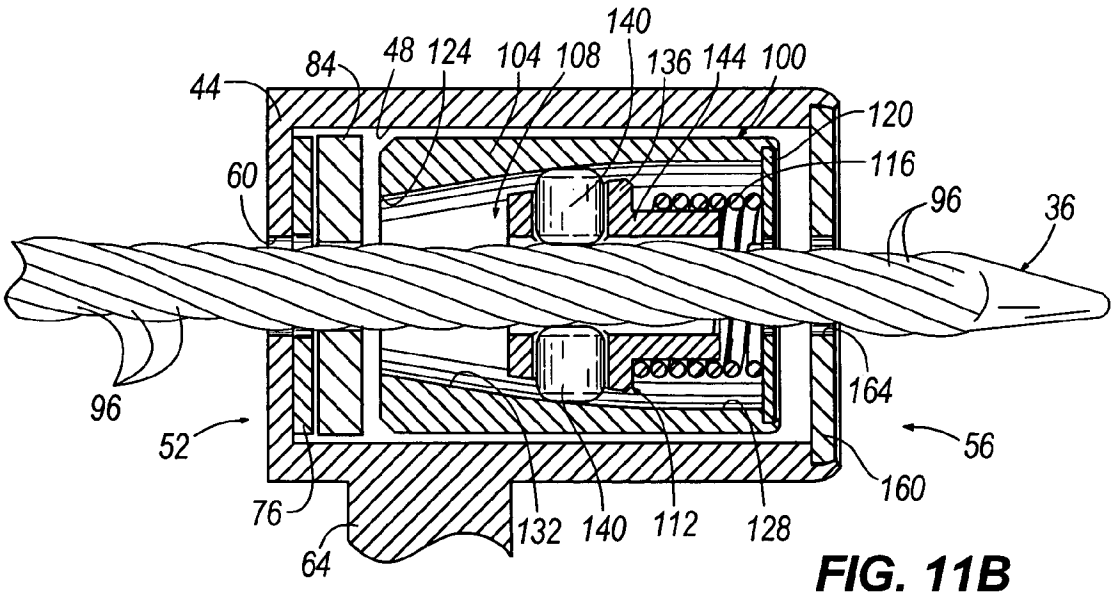

With particular reference to FIG. 11, the locked state of the exemplary cable lock 20 illustrated in the figures will now be described. To move the cable lock 20 from the unlocked state to the locked state, the free end of the cable 36 is inserted into the body 32 (e.g., the housing 44 in the illustrated embodiment) along the insertion axis 40. This end of the cable 36 is inserted through the inlet 60, the spacer aperture 80 and the wall aperture 88. Upon insertion of the cable 36 into the wall aperture 88, the spirals 96 of the cable 36 are received in engagement within the spiral grooves 92 of the wall aperture 88. Such close engagement inhibits ingress of an object (such as a pick or other tool) further into the cavity 48 of the housing 44 between the cable 36 and the wall 84. Also, by virtue of the spiral engagement between the cable 36 and the wall 84, the wall 84 rotates with the cable 36 as the cable 36 is inserted further along the insertion axis 40. In other embodiments not employing such a relationship between the cable 36 and the wall 84 (i.e., spiraled grooves or other features), the wall 84 need not rotate during insertion of the cable 36.

Upon further insertion of the cable 36, the cable is received within the locking assembly 100 and, particularly, into the carriage 112 through the locking assembly inlet 124. The cable 36 engages the balls 140 and pushes them outward against (if not already engaged) the narrowing diameter portion 132 of the carriage 112. The narrowness of the cavity diameter engaged by the balls 140 prevents the balls 140 from moving sufficiently outward away from the cable 36 to allow the cable 36 to pass thereby. Accordingly, applying an insertion force to the cable 36 sufficient to overcome the bias of the spring 116 will move the carriage 112 toward the end cap 120 and compress the spring 116. Rearward movement of the carriage 112 brings the balls 140 into engagement with a larger-diameter portion of the cavity 108, thereby allowing the balls 140 to move further outward and allowing the cable 36 to pass the balls 140. The cable 36 then passes through the end cap aperture 156 of the locking assembly 100 and finally exits the housing 44 through the end cap aperture 164. In this state, the spring 116 biases the carriage 112 toward the inlet 124 of the lock assembly housing 104 and toward the narrowing diameter portion 132 of the housing 104. The carriage 112 comes to rest when the balls 140 are sufficiently compressed between the narrowing diameter portion 132 of the housing 104 and the cable 36, thereby pinching the cable 36 between the balls 140.

During insertion of the cable 36 into and through the body 32, several types of rotation can occur depending upon the types and arrangements of elements employed in the lock 20 as described above. First, spiral engagement (if employed) between the wall 84 and the cable 36 causes the wall 84 to rotate as the cable 36 is passed through the body 32. The spacer 76 (if employed) can be rotatable relative to the housing 44 and is positioned between the wall 84 and the end 52 of the housing 44 to ease rotation of the wall 84 and to prevent engagement between the wall 84 and the end 52 of the housing 44, thereby reducing friction upon the wall 84 that could otherwise reduce the ability of the wall 84 to rotate. Secondly, the locking assembly 100 can rotate relative to the housing 44 during insertion of the cable 36 through the body 32. Rotation of the locking assembly 100 may be caused by rotational forces exerted on the balls 140 by the spirals 96 of the cable 36. Thirdly, the cable 36 and balls 140 can rotate relative to the housing 104 of the locking assembly 100. The rotational forces exerted by the spirals 96 of the cable 36 upon the balls 140 can be entirely absorbed by the balls 140 as they rotate about the cable 36 within the housing 104.

With continued reference to FIG. 11, the locking assembly 100 prevents the cable 36 from being pulled through the housing 44 in a direction opposite the direction of cable insertion. As mentioned above, the balls 140 are compressed between the cable 36 and the housing 104 of the locking assembly 100 (such as between the cable 36 and the narrowing diameter portion 132 of the housing 104), thereby pinching the cable 36 with the balls 140. Therefore, a force applied to the cable 36 in a direction opposite the cable insertion direction described above will apply a force on the locking assembly 100 in the direction opposite the cable insertion direction, will bias the balls 140 against the narrowing diameter portion 132 of the housing 104, and will therefore bias the balls 140 into tighter engagement with the cable 36. This engagement between the cable 36 and the balls 140 is sufficient to prevent the cable 36 from being pulled out of the body 32.

A number of the features and elements described above significantly increase the difficulty of picking or otherwise bypassing the lock of the present invention. Examples of how some of these features generate this result will now be discussed. In this regard, it should be noted that any of the features described above or hereafter can be employed alone or in combination as desired.

Referring back to FIGS. 6–7 and 11, the complimentary shapes of the cable 36 and wall aperture 88 (if employed) can prevent picks or other tools from penetrating past the wall 84 and further into the housing 44 in an effort to manipulate and possibly unlock the cable lock 20. In those cases where features of the wall aperture 88 are spiraled along the thickness of the wall 84 as described above, the complementary spiral shapes of the wall 84 and cable 36 further inhibit ingress of an object into the cavity 108 of the locking assembly 100 between the cable 36 and the wall 84. In addition, by enabling the wall 84 to rotate with respect to the housing 44, the ability of a thief to damage the wall 84 by repeatedly twisting the cable 36 is lessened or eliminated.

Another feature that inhibits a thief from bypassing the cable lock 20 is the engagement between the balls 140 and the cable 36. In some embodiments of the present invention, rotation of the cable 36 causes the balls 140 (or other gripping elements as described above) to rotate with the cable 36. Although the balls 140 do not roll by virtue of their firm engagement with the cable 36, the balls 140 can slide against the internal surface of the lock assembly housing 104 (i.e., orbiting the balls 104 about the insertion axis 40 of the housing 44). Such movement prevents the ability of a thief to loosen the grip of the lock 20 upon the cable 36 by rotating the cable 36 with force from outside of the housing 44.

Another feature of the cable lock 20 that inhibits bypassing of the lock 20 is the independent movement of the locking assembly 100 relative to the housing 44 in some embodiments of the present invention. In such embodiments, the housing 104 of the locking assembly 100 can rotate freely within and with respect to the housing 44 of the cable lock 20. Rotation of the cable 36 therefore causes the entire locking assembly 100 to rotate with the cable 36 relative to the housing 44, thereby inhibiting any slippage between the cable 36 and the locking assembly 100. In some embodiments, this relative rotation between the housings 104, 44 can be employed in conjunction with the relative movement between the balls 40 and the locking assembly housing 104 described above.

Referring back to FIGS. 8–9, the manner in which the end cap 160 of the illustrated exemplary embodiment is connected to the housing 44 also inhibits bypassing of the cable lock 20. As mentioned above, the housing 44 is crimped over and around edges of the end cap 160 to eliminate externally accessible gaps between the housing 44 and the end cap 160. Conventional cable locks have end caps connected to the housing in manners (e.g., crimping a terminal edge of the housing to the periphery of the end cap) that provide gaps between end caps and the lock housing. Such gaps are externally accessible by thieves, and provide a point at which a tool or machine can be inserted between the end cap and the housing in order to pry the end cap away from or off of the housing. With the end cap pried away from or off of the housing, the interior of the housing is accessible and the cable lock can be bypassed. Such gaps also provide a point at which an expansion tool or machine may engage the housing of the cable lock and uncrimp the housing from around the end cap. With the housing uncrimped, the end cap can easily be removed from the housing. To hide the fact that such conventional locks have been compromised, the end cap can be repositioned in the open end of the housing and a tool or machine can be employed to re-crimp the end of the housing around the end cap to secure it to the housing. The lack of externally accessible gaps in the cable lock 20 of the present invention therefore inhibits such methods of bypassing the cable lock 20.

Figure 12:
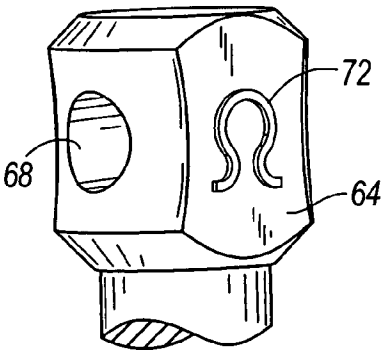
FIG. 12 is a partial perspective side view of the cable lock shown in FIG. 1.
Figure 12A:
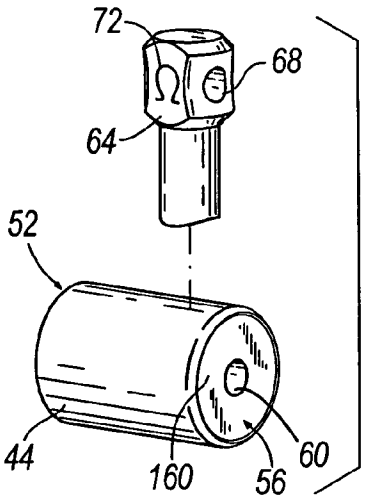

Referring now to FIG. 12, an indicator 72 (described above) on the body 32 is represented by an Omega by way of example only. Any letter, number, symbol, graphics, or combinations thereof can be located on the portion 64 of the body crimped to secure the cable 36 thereto. The indicator 72 can also have any size and color desired, and can be formed as a raised or relief portion of the body 32 (e.g., in a molding, casting, or machining operation), by printed, etched, or deposited matter on the body 32, or in any other manner desired. The indicator 72 is subject to damage by impact, scraping, scuffing, or other contact resulting from an attempt to re-crimp the body portion 64 upon a cable 36. By way of example only, indicators that are defined in the material of the body 32 (such as raised material portions defined during molding or other manufacturing operations) will deform under pressure of re-crimping, thereby providing a visual indication that the crimp 64 has been tampered with.

It should be understand that indicia 72 can be formed on other portions of the cable lock 20 to indicate whether the lock 20 has been tampering with. For example, indicia 72 can be formed on the open end 56 of the housing 44 that is crimped around the end cap 160. Such indicia 72 would indicate an effort to recrimp the housing 44 around the end cap 160 as described above.

Figure 13:
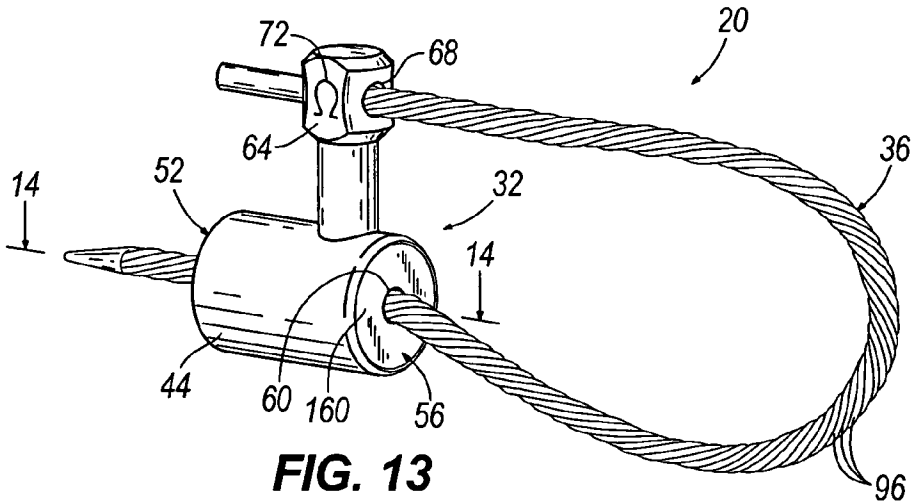
FIG. 13 is a perspective view of a cable lock according to another embodiment of the present invention, shown in a locked state.
Figure 14:
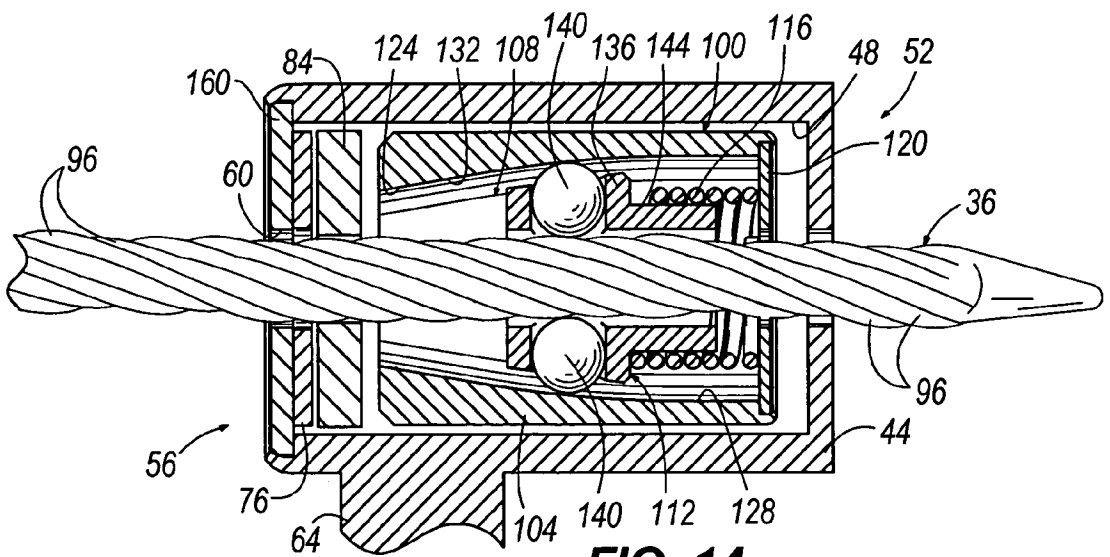
FIG. 14 is a cross-sectional view taken along line 14—14 in FIG. 13, shown with the cable lock in a locked state.

Referring now to FIGS. 13 and 14, another exemplary embodiment of the cable lock 20 according to the present invention is illustrated. With some exceptions (described in greater detail below), the cable lock 20 illustrated in FIGS. 13 and 14 is similar to the cable lock 20 described above with reference to FIGS. 1–12. Accordingly, reference is made to the above discussion regarding the structure, operation, and alternatives of the cable lock 20 illustrated in FIGS.

13 and 14, wherein like elements and features of the cable lock 20 illustrated in FIGS. 13 and 14 have like reference numerals.

The cable lock 20 illustrated in FIGS. 13 and 14 includes a housing 44 in which the closed end 52 and the open end 56 of the embodiment illustrated in FIGS. 1–12 are reversed in position. Specifically, the end cap 160 of the housing 44 defines the inlet 60 therethrough (rather than the closed end 52 of the housing), and the cable 36 is inserted into the housing 44 through the inlet 60 defined in the end cap 160. In addition, the spacer 76, wall 84, and the locking assembly 100 are reversed in position within the housing 44 compared to their positions and orientations in the embodiment of FIGS. 1–12. Accordingly, the spacer 76 is positioned adjacent the end cap 160, the wall 84 is positioned adjacent the spacer 76 such that the spacer 76 is positioned between the end cap 160 and the wall 84, and the inlet 124 of the locking assembly 100 is adjacent the wall 84.

The cable lock 20 illustrated in FIGS. 13 and 14 provides an additional advantage in that the ability of thieves to open the lock 20 by attempting to remove the end cap 160 is substantially reduced. In particular, the location of the cable 36 received within the inlet 60 of the housing reduces the ability of thieves to access the end cap 160 with tools and other equipment in an effort to uncrimp or unroll the housing 44 from the end cap 160.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. By way of example only, the features and elements of the various cable lock embodiments described above and illustrated in the figures can be employed regardless of whether the cable 36 is received entirely through the lock 20. Specifically, the housing 44 of the cable lock 20 need not necessarily have an aperture through which the end of the cable 36 can pass out of the housing 44 after being inserted fully therethrough. Instead, the cable 36 can terminate within the housing 44 while still permitting proper operation of the cable lock 20.

We claim:

1. A cable lock, comprising:

a cable having a cross-sectional shape, the cross-sectional shape of the cable having a radius varying at different circumferential positions of the cross-sectional shape;

a housing defining an internal cavity therein; and a wall positioned to block access into the cavity of the housing, the wall having an aperture defined therethrough, the aperture having a shape and having a radius varying at different circumferential positions of the aperture, at least a portion of the cross-sectional shape of the cable having a shape complementary to the shape of the aperture to inhibit ingress of an object into the internal cavity of the housing between the cable and the wall, wherein the wall is rotatable with respect to the housing in insertion of the cable through the aperture.

2. The cable lock of claim 1, wherein the wall is at least partially positioned within the housing.

3. The cable lock of claim 1, wherein the wall is disc-shaped.

4. The cable lock of claim 1, wherein the wall is shaped to prevent relative rotation between the cable and the wall.

5. The cable lock of claim 1, wherein:

the cable is a wire cable including wrapped wire spirals; and spiral grooves are defined in an edge of the aperture, the spiral grooves being complementarily shaped to the spirals and adapted to receive the spirals therein when the cable is inserted through the aperture.

6. A cable lock, comprising:

a cable having a cross-sectional shape, the cross-sectional shape of the cable having a radius varying at different circumferential positions of the cross-sectional shape;

a housing defining an internal cavity therein; and a wall positioned to block access into the cavity of the housing, the wall having an aperture defined therethrough, the aperture having a shape and having a radius varying at different circumferential positions of the aperture, at least a portion of the cross-sectional shape of the cable having a shape complementary to the shape of the aperture to inhibit ingress of an object into the internal cavity of the housing between the cable and the wall, wherein the wall has a thickness and the aperture of the wall has a shape substantially the same throughout the thickness, and wherein the shape of the aperture is twisted from a front surface of the wall to a rear surface of the wall about an axis extending through the housing and the aperture.

7. A cable lock, comprising:

a cable having a cross-sectional shape, the cross-sectional shape of the cable having a radius varying at different circumferential positions of the cross-sectional shape;

a housing defining an internal cavity therein; and a wall positioned to block access into the cavity of the housing, the wall having an aperture defined therethrough, the aperture having a shape and having a radius varying at different circumferential positions of the aperture, at least a portion of the cross-sectional shape of the cable having a shape complementary to the shape of the aperture to inhibit ingress of an object into the internal cavity of the housing between the cable and the wall, wherein the aperture has a scalloped shape twisted from a front surface of the wall to a rear surface of the wall about an axis extending through the housing and the aperture.

8. A cable lock, comprising:

a cable having a cross-sectional shape, the cross-sectional shape of the cable having a radius varying at different circumferential positions of the cross-sectional shape;

a housing defining an internal cavity therein; and a wall positioned to block access into the cavity of the housing, the wall having an aperture defined therethrough, the aperture having a shape and having a radius varying at different circumferential positions of the aperture, at least a portion of the cross-sectional shape of the cable having a shape complementary to the shape of the aperture to inhibit ingress of an object into the internal cavity of the housing between the cable and the wall, wherein spiral grooves are defined in an edge of the aperture and from a front surface of the wall to a rear surface of the wall.

9. A method of locking a cable lock, the method comprising:

inserting an end of a cable into and through an aperture of a wall, the cable having a cross-sectional shape with a radius varying at different circumferential positions of the cable, the aperture having a cross-sectional shape with a radius varying at different circumferential positions of the aperture, the cable and aperture having complementary shapes;

inserting the end of the cable into and through a housing in a first direction;

rotating the wall with respect to the housing;

preventing movement of the cable through the housing in a second direction substantially opposite the first direction; and blocking ingress of objects into the housing along a surface of the cable through the aperture by the complementary shapes of the cable and aperture.

10. The method of claim 9, further comprising positioning the wall at least partially within the housing.

11. The method of claim 9, wherein the wall is disc-shaped.

12. The method of claim 9, wherein the wall has a thickness and the aperture of the wall has a shape substantially the same throughout the thickness.

13. The method of claim 12, wherein the shape of the aperture is twisted from a front surface of the wall to a rear surface of the wall about an axis extending through the housing and the aperture.

14. The method of claim 9, wherein the aperture has a scalloped edge.

15. The method of claim 9, wherein the wall is shaped to prevent relative rotation between the cable and the wall.

* * * * *